United States Patent [19]

Jackson

[11] 4,087,913

[45] May 9, 1978

[54] UTILITY FIXTURE LOCATOR AND CUTTER

[76] Inventor: Hubert Hassel Jackson, 2512 21st St., Santa Monica, Calif. 90405

[21] Appl. No.: 789,889

[22] Filed: Apr. 22, 1977

[51] Int. Cl.[2] ..... B26F 1/00

[52] U.S. Cl. ..... 30/360; 30/366; 33/DIG. 10

[58] Field of Search ..... 30/358, 359, 360, 368; 33/DIG. 10, 197

[56] References Cited

U.S. PATENT DOCUMENTS

| | | | |
|---|---|---|---|
| 2,787,324 | 4/1957 | Hartmeister | 30/360 |
| 3,348,310 | 10/1967 | Gottauf | 30/360 |
| 3,391,460 | 7/1968 | Moore | 30/366 |
| 3,683,499 | 8/1972 | Robinson | 30/360 |
| 3,924,331 | 12/1975 | Goosen | 30/366 |

*Primary Examiner*—Jimmy C. Peters

*Attorney, Agent, or Firm*—Ralph B. Pastoriza

[57] ABSTRACT

The locator and cutter includes a first member in the form of a plate arranged to be affixed to a fixture supported on a stud frame. An externally threaded shaft is affixed to the plate and extends perpendicularly to the plane of the stud frame and terminates in a sharp point. A panel can be positioned over the stud frame and pressed towards the fixture so that the shaft will poke through the panel and thus locate the position of the fixture. A second member in the form of a box has blades outlining a given shape to be cut out of the panel, the box fitting over the extending threaded shaft. A handle has an internally threaded hub receivable on the shaft so that rotation of the handle will draw the first plate member and second box member towards each other causing the blades to cut out an opening of desired shape in the panel. Access is thus provided to the fixture.

5 Claims, 5 Drawing Figures

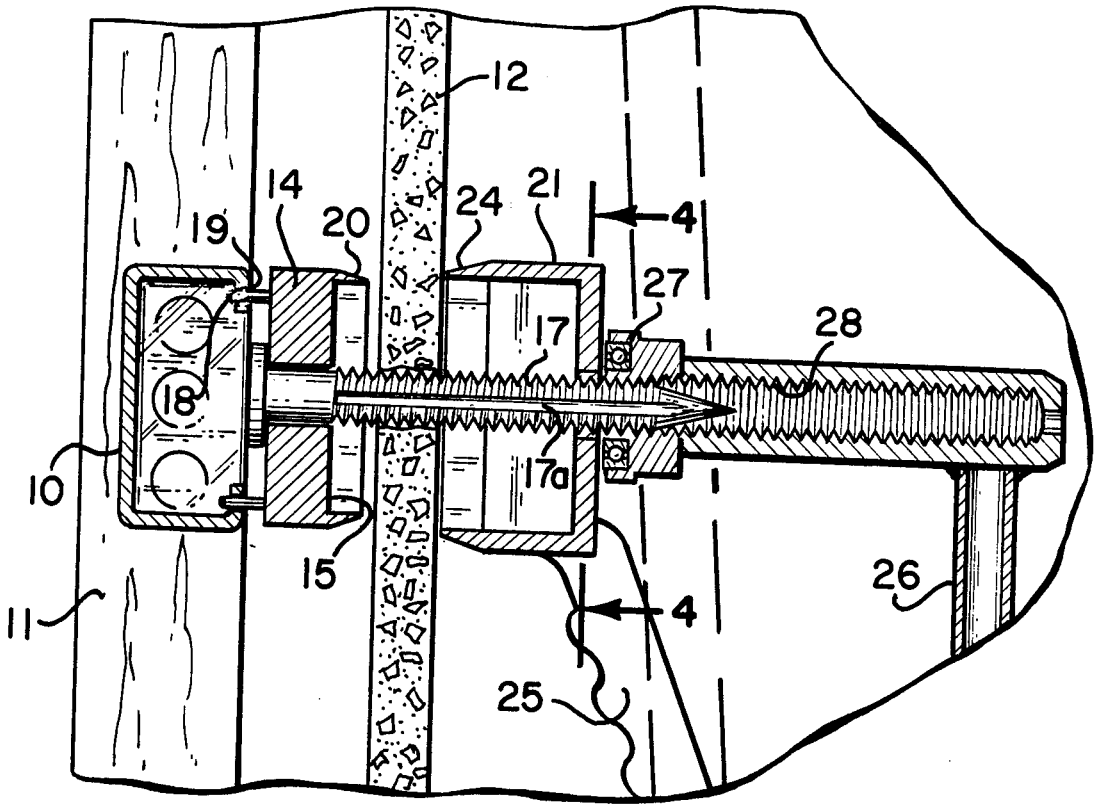

UTILITY FIXTURE LOCATOR AND CUTTER

This invention relates generally to tools utilized in the building industry and more particularly to a utility fixture locator and cutter for locating and cutting an opening of given shape in a panel to be positioned over a fixture to thereby provide access to the fixture after the panel is in place.

BACKGROUND OF THE INVENTION

In commercial building construction, it is normal practice to apply dry wall plaster or equivalent paneling to stud frames forming interior walls. Normally the stud frames themselves will carry fixtures such as electrical outlet fixtures at periodic points along a wall surface. In thus affixing a dry wall plaster panel or even a wood panel, it is necessary to provide a cut-out in the panel to provide access to the fixture in question.

Normally, appropriate measurements are taken of the horizontal and vertical position of the fixture on the stud frame and then corresponding measurements are made on the panel and an appropriate opening is cut out from the panel corresponding to the outline of the fixture.

The foregoing operation is somewhat time consuming. Moreover, unless exact dimensions are taken, the cut-out in the panel may be slightly out of registration with the fixture after the panel is in place with the result that the entire panel is wasted and the operation must be repeated with a new panel.

BRIEF DESCRIPTION OF THE PRESENT INVENTION

With the foregoing considerations in mind, the present invention contemplates a special tool in the form of a utility fixture locator and cutter which will avoid the foregoing problems of taking physical measurements in order to provide a proper cut-out in a panel.

More particularly, in accord with this invention there is provided a first member having first thread means and hole punching means for temporarily affixing to the fixture such that a panel can be positioned over the fixture and pressed towards the fixture to cause the hole punching means on the member to penetrate through the panel thereby indicating on the exterior of the panel the location of the fixture. A second member incorporating cutting blades outlining a given shape is receivable over the hole punching means with the cutting blades opposing the exterior surface of the panel. A cooperating second thread means is provided for engaging the first thread means and is rotatable to force the first and second members towards each other to thereby cut an opening in the panel of the desired given shape.

In the preferred embodiment of the invention, the first plate member is also provided with cutting blades opposing the cutting blades on the second member and the hole punching means takes the form of a threaded shaft terminating in a sharp point which extends from the first member in a direction generally normal to the plane of the stud frame so that it will readily poke through the panel when the panel is pressed against the stud frame in proper position.

BRIEF DESCRIPTION OF THE DRAWINGS

A better understanding of this invention will be had by now referring to the accompanying drawings in which.

DETAILED DESCRIPTION OF THE PREFERRED EMBODIMENT

Figure 1:
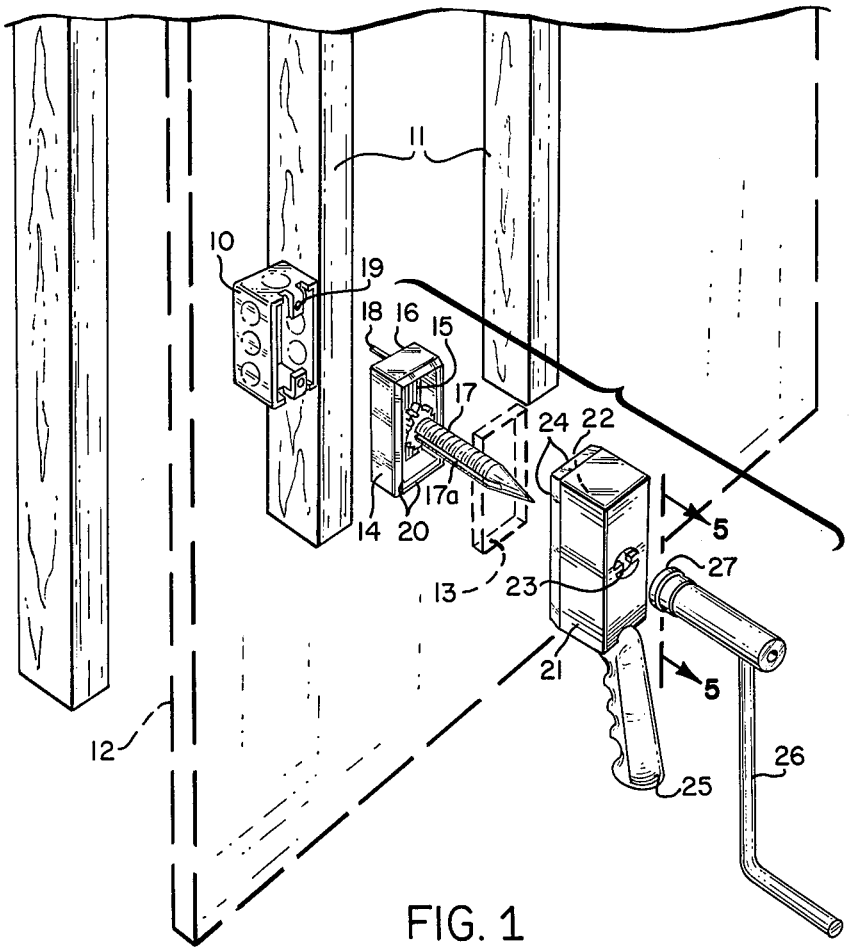
FIG. 1 is a perspective view of a stud frame supporting a fixture to which a panel is to be affixed, the utility fixture locator and cutter of this invention being shown in exploded view.

Referring first to FIG. 1, there is shown a fixture which, in the example set forth for illustrative purposes, comprises an electrical outlet fixture box 10 supported by a stud framing indicated generally by the numeral 11.

Indicated by phantom lines in order to avoid obscuring other portions of the drawing is a panel 12 arranged to be positioned over the stud frame 11 and fixture 10. This panel may constitute dry wall type plaster, wood, or any other paneling that might be used in wall construction.

It will be appreciated that in order to provide access to the fixture 10, there must be provided an opening in the panel 12 of corresponding outline. In FIG. 1, such a cut-out opening is indicated by the dashed lines 13.

As mentioned heretofore, the provision of this cut-out normally requires making vertical and horizontal measurements of the location of the fixture 10 relative to fixed reference points and then effecting similar measurements on the panel 12. A saw is then used to cut out the appropriate opening.

In order to avoid the foregoing laborious steps, the present invention provides a locator and cutter which will provide the desired cut-out opening in the panel 12 without the necessity of making any measurements.

Thus, as shown in FIG. 1, this locator and cutter includes a first member in the form of a plate 14 having front and rear surfaces 15 and 16. Also provided is an externally threaded shaft 17 terminating in a sharp point secured to and extending normally away from the front surface 15.

The back surface 16 of the plate 14 includes pin means such as indicated at 18 for temporarily affixing the plate 14 to the fixture 10 as by hooking the pin 18 into a normally provided tapped opening 19 in the fixture. The plate 14 thus overlies the fixture and is provided with a similar perimeter.

Plate 14 also includes in the preferred embodiment first blade means 20 which follow a perimeter or outline corresponding to that of the fixture 10, these blades facing forwardly from the front surface 15 as shown.

With the foregoing arrangement, the plate 14 can be secured over the fixture 10 and the panel 12 then positioned against the stud frame 11 and pressed towards the fixture 10. The shaft 17 will penetrate through the panel 12 thus providing on the exterior of the panel an indication of the location of the fixture 10.

Still referring to FIG. 1, the locator and cutter of this invention includes a second member in the form of a box structure 21 having a rear opening 22 with a bore 23 in its opposite front wall for receiving the shaft 17 with the rear opening 22 opposing the exterior or outer surface of the panel 12. A second cutting blade means 24 is secured about the perimeter of the rear opening 22 of the box structure in opposed relationship to the first cutting blades 20 of the plate 14 on the other side of the panel 12. The box 21 may include a grip 25 for aiding in positioning the same over the shaft 17 in juxtaposed relationship to the plate 14.

The assembly is completed by the provision of a handle 26 having an internally threaded hub 27 threadedly receiving the shaft 17. The exterior periphery of the hub 27 seats against the front surface of the box about the bore 23.

Figure 2:
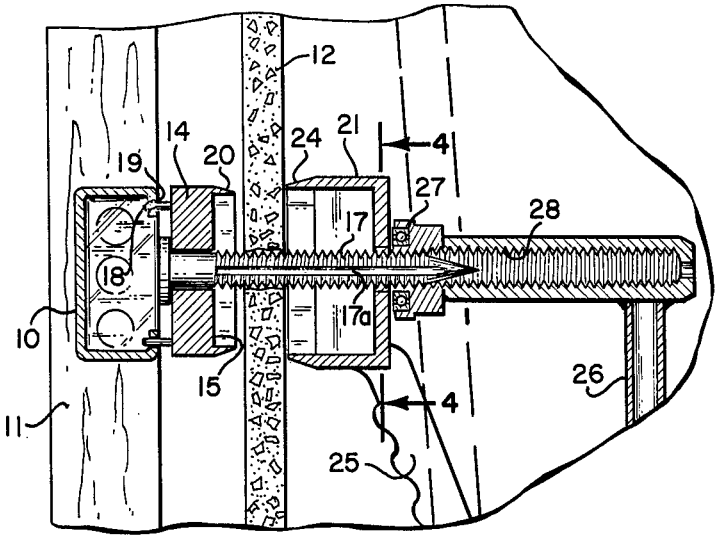
FIG. 2 is a fragmentary cross section of the locator and cutter of FIG. 1 in assembled relationship preparatory to cutting an opening in a panel positioned over the stud frame.

Referring to the assembled cross section of FIG. 2, the panel 12 is shown as having been pressed towards the fixture 10 so that the shaft 17 has poked through the panel to the other side thereof. Further, the second member in the form of the box 21 is shown positioned over the shaft 17, the shaft protruding through the bore 23 in the front wall of the box 21. This bore effectively indexes the relative positions of the second cutting blades 24 relative to the first cutting blades 20 on the plate 14 so that they are in opposing relationship.

It will now be seen that when the hub 27 is threaded onto the extending shaft 17, by way of the internal threads 28, rotation by the handle portion 26 of the hub will draw the plate member 14 towards the box member 21; in fact, both of these members will be drawn towards each other so that the plate 14 will extend towards and into the box 21, the blades 20 passing within the blades 24 in a scissoring action.

Figure 3:
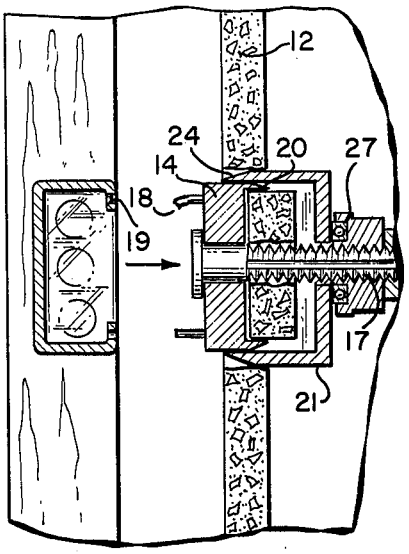
FIG. 3 is a view similar to FIG. 2 illustrating the relative positions of component parts after a cutting operation has been completed.

With reference to FIG. 3, the position of the plate 14 within the entrance portion of the box 21 is illustrated after substantial threading has taken place and it will be appreciated that an appropriate opening has been cut out of the panel 12.

Since the perimeter outline defined by the blades 20 and 24 corresponds to that of the fixture 10, the cut-out opening as indicated in dashed lines in FIG. 1 at 13 will be of a corresponding shape and will register with the fixture 10 to provide access thereto.

It will be clear in FIG. 3 that the plate 14 is simply withdrawn through the cut-out opening once the panel 12 is in place.

Figure 4:
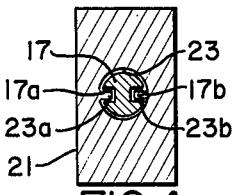
FIG. 4 is a front elevational view of a portion of the cutter taken in the direction of the arrows 4—4 of FIG. 2.

In FIG. 4, it will be noted that the bore 23 in the front wall of the box 21 includes radially inwardly directed diametrically opposite projections **23*a* and 23*b*. These projections are receivable in axially extending grooves 17*a* and 17*b* on diametrically opposite sides of the threaded shaft 17 to thereby key the box 21 against rotation relative to the shaft as the handle 26 of FIG. 1 is being rotated. It will also be appreciated that this keying arrangement assures proper orientation of the box 21 on the exterior surface of the panel 12 preparatory to drawing the member 14 on the other side of the panel towards the box 21**.

Figure 5:
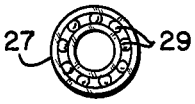
FIG. 5 is another elevational view of a different component of the cutter taken in the direction of the arrows 5—5 of FIG. 1.

In the view of FIG. 5, it will be noted that the exterior periphery of the hub 27 includes ball bearings 29. These ball bearings will be positioned against the front surface of the box 21 about the bore 23 to facilitate rotation of the handle.

OPERATION

The operation of the locator and cutter of this invention will be evident from all of the foregoing. As already described, the plate 14 is simply temporarily secured to the fixture 10 as by means of inserting the pin 18 into the normally provided threaded tap 19. Panel 12 is then positioned against the stud frame 11 and pressed towards the fixture 10 so that the shaft 17 will poke through or penetrate the panel 12.

The box 21 is then positioned over the shaft 17 this shaft extending through the opening 23 with the small projections riding in the diametrically opposite grooves **17*a* and 17*b*** as described.

Finally, the hub 27 is received over the projecting end of the shaft 17 as shown in FIG. 2, the internal threads 28 mating with the external threads on the shaft 17 so that rotation by the handle 26 will draw the plate member 14 towards the box member 21.

An appropriate cut-out of given shape thus can be readily effected, the members together with the cut-out portion as shown in FIG. 3 simply being withdrawn through the cut-out opening.

It is clear from all of the foregoing that the cut-out opening will be in exact registration with the fixture involved so that ready access is had thereto.

Moreover, since making actual physical measurements of location of the fixture and an appropriate corresponding location on the panel is eliminated, chances of error are also eliminated so that improper cuts in panels are avoided together with the disadvantage of a wasted panel.

It will be understood, of course, that the given shape of the cut-out can be varied from the rectangular shape shown to any other appropriate shape such as hexagonal or the like by providing the blades 20 and 24 on the plate 14 and box 21 respectively of the desired outline.

From all of the foregoing, it will thus be evident that the present invention has provided a novel and useful utility fixture locator and cutter tool.

I claim:

1. A utility fixture locator and cutter for locating and cutting an opening of given shape in a panel to be positioned over the fixture to thereby provide access to the fixture after said panel is in place, comprising, in combination:

(a) a first member having first thread means and hole punching means for temporarily affixing to said fixture such that said panel can be positioned over said fixture and pressed towards the fixture to cause said hole punching means on said member to penetrate through said panel thereby indicating on the exterior of the panel the location of said fixture;

(b) a second member having cutting blades outlining said given shape receivable over the hole punching means with the cutting blades opposing the exterior surface of the panel; and (c) cooperating second thread means for engaging said first thread means and rotatable to force said first and second members towards each other to thereby cut an opening in said panel of said given shape.

2. The subject matter of claim 1, in which said first thread means constitute external threads on said hole punching means.

3. A utility fixture locator and cutter for locating and cutting an opening of given shape in a panel to be positioned over a fixture supported on a stud frame to thereby provide access to the fixture after the panel is in place over the stud frame, comprising, in combination:

(a) a plate having front and back surfaces and an externally threaded shaft terminating in a sharp point secured to and extending normally away from said front surface, said back surface including extending pin means for supporting said plate over said fixture with said shaft extending perpendicularly away from the plane of said stud frame whereby a panel can be positioned over said stud frame and fixture and pressed against the stud frame so that said point in said shaft penetrates through said panel;

(b) first cutting blades secured about the perimeter of the front surface of said plate facing forwardly and defining the outline of said given shape;

(c) a box structure having a rear opening with a bore in its opposite front wall for receiving said shaft with the rear opening opposing the outer surface of said panel;

(d) second cutting blades secured about the perimeter of said rear opening of said box structure in opposed relationship to said first cutting blades on the other side of said panel; and (e) a handle having an internally threaded hub threadedly receiving said shaft, the exterior periphery of the hub seating against said front surface of said box about said bore whereby rotation of said handle will draw said shaft and plate towards and into the rear opening in said box, said first and second blades cutting through said panel from opposite sides to provide said cut-out opening in said panel of said given shape.

4. The subject matter of claim 3, in which said shaft includes axially extending grooves on diametrically opposite sides and said bore in the front wall of said box includes radially inwardly extending diametrically opposite projections receivable in said grooves to key said box against rotation relative to said shaft as said handle is being rotated.

5. The subject matter of claim 4, in which said exterior periphery of said hub includes ball bearings positioned against said front surface of said box about said bore to facilitate rotation of said handle.

* * * * *